US009715804B1

(12) United States Patent
Bergman et al.

(10) Patent No.: US 9,715,804 B1
(45) Date of Patent: Jul. 25, 2017

(54) ROLLING CODE SECURITY SCHEME FOR TAG DETECTION ROBUSTNESS

(71) Applicants: Adam S. Bergman, Boca Raton, FL (US); Manuel Soto, Lake Worth, FL (US); Guillermo H. Padula, Boca Raton, FL (US)

(72) Inventors: Adam S. Bergman, Boca Raton, FL (US); Manuel Soto, Lake Worth, FL (US); Guillermo H. Padula, Boca Raton, FL (US)

(73) Assignee: Tyco Fire & Security GmbH, Neuhausen AM Rheinfall (CH)

( * ) Notice: Subject to any disclaimer, the term of this patent is extended or adjusted under 35 U.S.C. 154(b) by 19 days.

(21) Appl. No.: 15/145,500

(22) Filed: May 3, 2016

(51) Int. Cl.
*G08B 13/24* (2006.01)

(52) U.S. Cl.
CPC ..... *G08B 13/246* (2013.01)

(58) Field of Classification Search
CPC ..... G08B 13/246
See application file for complete search history.

(56) References Cited

U.S. PATENT DOCUMENTS 5,426,419 A 6/1995 Nguyen et al.
5,528,914 A 6/1996 Nguyen et al.
5,535,606 A 7/1996 Nguyen et al.
5,942,978 A 8/1999 Shafer
5,955,951 A 9/1999 Wischerop et al.
7,672,260 B2 * 3/2010 Wood, Jr. ..... G06K 7/0008 340/10.1
8,134,452 B2 * 3/2012 Tuttle ..... H04Q 9/00 340/10.1
2006/0022800 A1 * 2/2006 Krishna ..... G06K 7/0008 340/10.2
2008/0012710 A1 * 1/2008 Sadr ..... G06K 7/0008 340/572.1
2008/0180222 A1 * 7/2008 Hollister ..... H04L 29/12264 340/10.3
2009/0303014 A1 * 12/2009 Brommer ..... G06K 19/072 340/10.2
2012/0280796 A1 * 11/2012 Gravelle ..... G06K 7/10039 340/10.2
2013/0234831 A1 * 9/2013 Sabesan ..... G06K 7/0008 340/10.2

* cited by examiner

*Primary Examiner* — Patrick Edouard
*Assistant Examiner* — Eboni Hughes
(74) *Attorney, Agent, or Firm* — Fox Rothschild LLP; Robert J. Sacco; Carol E. Thorstad-Forsyth

(57) ABSTRACT

Systems (100) and methods (900) for detecting the presence of a security tag. The methods involve performing operations by a master pedestal of an EAS system to determine a first Tx/Rx scheme to be used during a first iteration of an EAS tag detection process based on (A) a first total number of time windows randomly selected from a plurality of total number of time windows in which an EAS exciter signal should be transmitted from at least one pedestal, and (B) first time windows randomly selected from a plurality of time windows in which the EAS exciter signal can be sent during the EAS tag detection process. Information specifying the first Tx/Rx scheme is communicated from the master pedestal to at least one slave pedestal. Transmit and receive operations are performed by the master and slave pedestals in accordance with the first Tx/Rx scheme.

20 Claims, 7 Drawing Sheets

| Time Window ("TW") Tx/Rx 702 | Time Window Tx/Rx 704 | Time Window Tx/Rx 706 | Time Window No Tx, but still Rx 708 |
|---|---|---|---|

FIG. 7

| | | | | | | | | | | |
|---|---|---|---|---|---|---|---|---|---|---|
| Tx/Rx Scheme for First Iteration of An EAS Tag Detection Process | TW 802 Tx/Rx | TW 804 Tx/Rx | TW 806 Rx | TW 808 Rx | TW 810 Tx/Rx | TW 812 Rx | TW 814 Tx/Rx | TW 816 Rx | TW 818 Rx | TW 820 Tx/Rx |
| Tx/Rx Scheme for Second Iteration of An EAS Tag Detection Process | TW 802 Tx/Rx | TW 804 Tx/Rx | TW 806 Tx/Rx | TW 808 Tx/Rx | TW 810 Rx | TW 812 Tx/Rx | TW 814 Rx | TW 816 Tx/Rx | TW 818 Rx | TW 820 Rx |
| Tx/Rx Scheme for Third Iteration of An EAS Tag Detection Process | TW 802 Tx/Rx | TW 804 Tx/Rx | TW 806 Rx | TW 808 Rx | TW 810 Tx/Rx | TW 812 Tx/Rx | TW 814 Tx/Rx | TW 816 Rx | TW 818 Tx/Rx | TW 820 Tx/Rx |

FIG. 8

ROLLING CODE SECURITY SCHEME FOR TAG DETECTION ROBUSTNESS

FIELD OF THE INVENTION

This document relates generally to security tag detection. More particularly, this document relates to systems and methods for validating the presence of a security tag using a rolling code security scheme for tag detection.

BACKGROUND OF THE INVENTION

Electronic Article Surveillance ("EAS") systems are often used by retail stores in order to minimize loss due to theft. One common way to minimize retail theft is to attach a security tag to an article such that an unauthorized removal of the article can be detected. In some scenarios, a visual or audible alarm is generated based on such detection. For example, a security tag with an EAS element (e.g., an acousto-magnetic element) can be attached to an article offered for sale by a retail store. An EAS exciter signal is transmitted at the entrance and/or exit of the retail store. The EAS exciter signal causes the EAS element of the security tag to produce a detectable response if an attempt is made to remove the article without first detaching the security tag therefrom. The security tag must be detached from the article upon purchase thereof in order to prevent the visual or audible alarm from being generated.

One type of EAS security tag can include a tag body which engages a tack. The tack usually includes a tack head and a sharpened pin extending from the tack head. In use, the pin is inserted through the article to be protected. The shank or lower part of the pin is then locked within a cooperating aperture formed through the housing of the tag body. In some scenarios, the tag body may contain a Radio Frequency Identification ("RFID") element or label. The RFID element can be interrogated by an RFID reader to obtain RFID data therefrom.

The EAS security tag may be removed or detached from the article using a detaching unit. Examples of such detaching units are disclosed in U.S. Pat. No. 5,426,419 ("the '419 patent"), U.S. Pat. No. 5,528,914 ("the '914 patent"), U.S. Pat. No. 5,535,606 ("the '606 patent"), U.S. Pat. No. 5,942,978 ("the '978 patent") and U.S. Pat. No. 5,955,951 ("the '951 patent"). The detaching units disclosed in the listed patents are designed to operate upon a two-part hard EAS security tag. Such an EAS security tag comprises a pin and a molded plastic enclosure housing EAS marker elements. During operation, the pin is inserted through an article to be protected (e.g., a piece of clothing) and into an aperture formed through at least one sidewall of the molded plastic enclosure. The pin is securely coupled to the molded plastic enclosure via a clamp disposed therein. The pin is released by a detaching unit via a probe. The probe is normally retracted within the detaching unit. Upon actuation, the probe is caused to travel out of the detaching unit and into the enclosure of the EAS security tag so as to release the pin from the clamp or disengage the clamp from the pin. Once the pin is released from the clamp, the EAS security tag can be removed from the article.

SUMMARY OF THE INVENTION

The present document concerns implementing systems and methods for detecting the presence of a security tag. The methods involve performing operations by a master pedestal of an EAS system to determine a first Tx/Rx scheme to be used during a first iteration of an EAS tag detection process. The first Tx/Rx scheme specifies during which time windows of a plurality of time windows a pedestal is to only transmit, only receive, or both transmit and receive. Accordingly, this determination is based on: (A) a first total number of time windows randomly selected from a plurality of total number of time windows in which an EAS exciter signal should be transmitted from at least one pedestal; and (B) first time windows randomly selected from the plurality of time windows in which the EAS exciter signal can be sent during the EAS tag detection process. Next, information specifying the first Tx/Rx scheme is communicated from the master pedestal to at least one slave pedestal of the EAS system. This communication can be achieved using a wired or wireless communications link. Thereafter, the master and slave pedestals perform transmit and receive operations in accordance with the first Tx/Rx scheme.

The master and/or slave pedestals make a determination that a responding device is not an EAS security tag when a response signal is received by at least one of the master pedestal and the slave pedestal during a time window in which the EAS exciter signal was not transmitted. In contrast, the master and/or slave pedestals make a determination that the responding device is an EAS security tag when a response signal is received by at least one of the master pedestal and the slave pedestal exclusively during time windows in which the EAS exciter signal was transmitted. An alarm may then be issued indicating that the presence of an EAS security tag has been detected.

In some scenarios, the first total number of time windows is different than a second total number of time windows on which a second Tx/Rx scheme was based. The first time windows may also be different than second time windows randomly selected from the plurality of time windows for purposes of determining the second Tx/Rx scheme. The second Tx/Rx scheme is used by the master pedestal during a second iteration of the EAS tag detection process.

In those or other scenarios, the master pedestal randomly selects the first Tx/Rx scheme from a pre-defined set of Tx/Rx schemes. Alternatively, the master pedestal randomly selects the total number of time windows and the first time windows using a first chaotic, random or pseudo-random algorithm. The first chaotic, random or pseudo-random algorithm may be different than a second chaotic, random or pseudo-random algorithm employed by another master pedestal. A seed value for the first chaotic, random or pseudo-random algorithm is a unique fixed value associated with the master pedestal or a variable value determined by the master pedestal during operations thereof. In effect, the master pedestal can randomly select a different Tx/Rx scheme for a plurality of iterations of the EAS tag detection process.

DESCRIPTION OF THE DRAWINGS

Embodiments will be described with reference to the following drawing figures, in which like numerals represent like items throughout the figures, and in which:

FIGS. 7-8 comprise schematic illustrations that are useful for understanding Tx/Rx schemes.

DETAILED DESCRIPTION OF THE INVENTION

Figure 1:
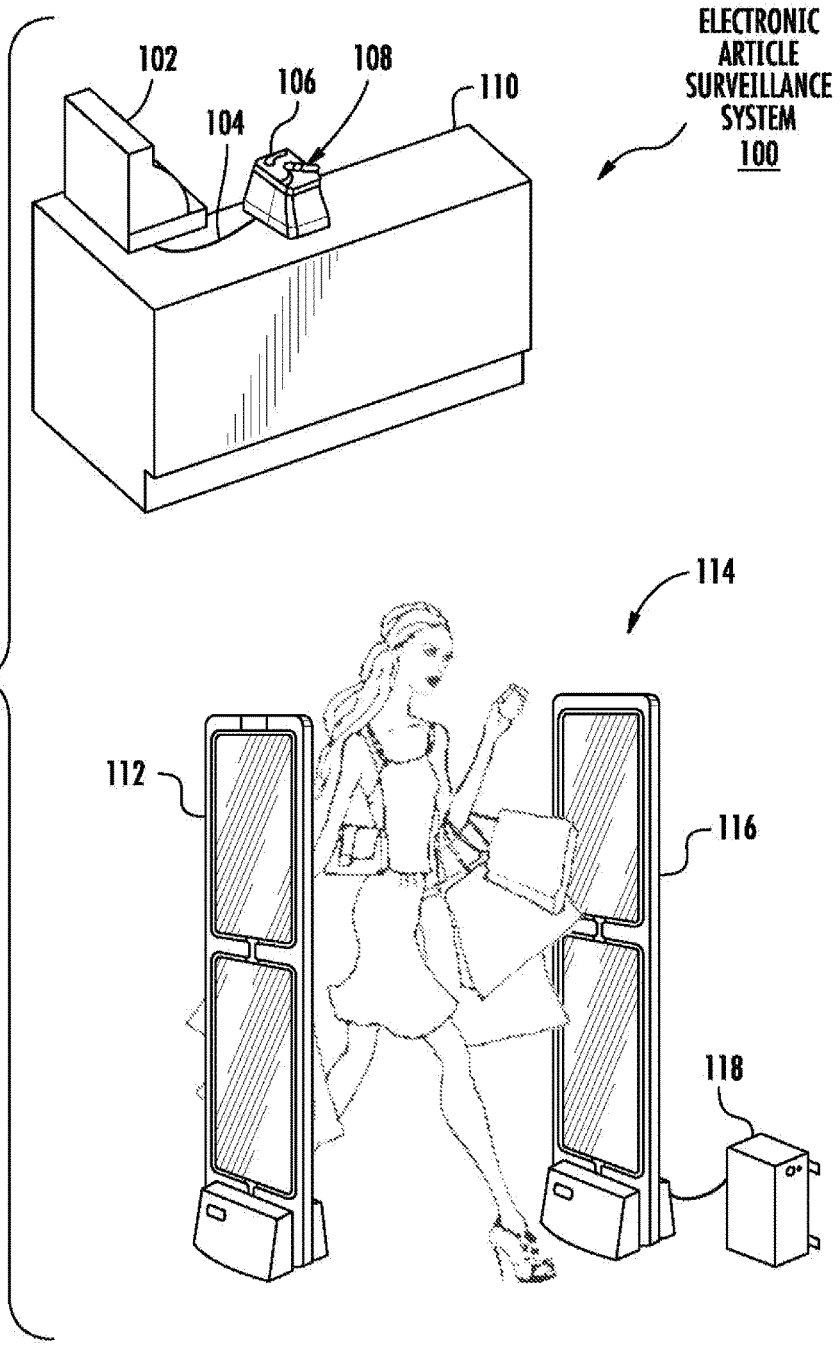
FIG. 1 is a schematic illustration of an exemplary architecture for an EAS system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Novel Electronic Article Surveillance ("EAS") tag detection systems will now be described with respect to FIGS. 1-10. These systems implement methods for detecting the presence of a security tag. The methods generally involve performing operations by a master pedestal of an EAS system to determine a first Tx/Rx scheme to be used during a first iteration of an EAS tag detection process. The first Tx/Rx scheme is based on: (A) a first randomly selected total number of time windows in which an EAS exciter signal should be transmitted from at least the master pedestal; and (B) first time windows randomly selected from a plurality of time windows in which the EAS exciter signal can be sent during the EAS tag detection process. Next, information specifying the first Tx/Rx scheme is communicated from the master pedestal to at least one slave pedestal of the EAS system. The master and slave pedestals then perform transmit and receive operations in accordance with the first Tx/Rx scheme.

Referring now to FIG. 1, there is provided a schematic illustration of an exemplary EAS system 100 that is useful for understanding the present invention. EAS systems are well known in the art, and therefore will not be described in detail herein. Still, it should be understood that the present invention will be described herein in relation to an acousto-magnetic (or magnetostrictive) EAS system. Embodiments of the present invention are not limited in this regard. The EAS system 100 may alternatively include a magnetic EAS system, an RF EAS system, a microwave EAS system or other type of EAS system. In all cases, the EAS system 100 generally prevents the unauthorized removal of articles from a retail store.

In this regard, EAS security tags 108 are securely coupled to articles (e.g., clothing, toys, and other merchandise) offered for sale by the retail store. At the exits of the retail store, detection equipment 114 sounds an alarm or otherwise alerts store employees when it senses an active EAS security tag 108 in proximity thereto. Such an alarm or alert provide notification to store employees of an attempt to remove an article from the retail store without proper authorization.

In some scenarios, the detection equipment 114 comprises antenna pedestals 112, 116. The antenna pedestals 112, 116 are configured to create a surveillance zone at the exit or checkout lane of the retail store by transmitting an EAS exciter signal. The EAS exciter signal causes an active EAS security tag 108 to produce a detectable response if an attempt is made to remove the article from the retail store. For example, the EAS security tag 108 can cause perturbations in the EAS exciter signal.

The antenna pedestals 112, 116 may also be configured to act as RFID readers. In these scenarios, the antenna pedestals 112, 116 transmit an RFID interrogation signal for purposes of obtaining RFID data from the active EAS security tag 108. The RFID data can include, but is not limited to, a unique identifier for the active EAS security tag 108. In other scenarios, these RFID functions are provided by devices separate and apart from the antenna pedestals.

The EAS security tag 108 can be deactivated and detached from the article using a detaching unit 106. Typically, the EAS security tag 108 is removed or detached from the articles by store employees when the corresponding article has been purchased or has been otherwise authorized for removal from the retail store. The detaching unit 106 is located at a checkout counter 110 of the retail store and communicatively coupled to a POS terminal 102 via a wired link 104. In general, the POS terminal 102 facilitates the purchase of articles from the retail store.

Detaching units and POS terminals are well known in the art, and therefore will not be described herein. The POS terminal 102 can include any known or to be known POS terminal with or without any modifications thereto. However, the detaching unit 106 includes any known or to be known detaching unit selected in accordance with a particular application.

In some cases, the detaching unit 106 is configured to operate as an RFID reader. As such, the detaching unit 106 may transmit an RFID interrogation signal for purposes of obtaining RFID data from an EAS security tag 108. Upon receipt of the unique identifier, the detaching unit 106 communicates the unique identifier to the POS terminal 102. At the POS terminal 102, a determination is made as to whether the unique identifier is a valid unique identifier for an EAS security tag of the retail store. If it is determined that the unique identifier is a valid unique identifier for an EAS security tag of the retail store, then the POS terminal 102 notifies the detaching unit 106 that the unique identifier has been validated, and therefore the EAS security tag 108 can be removed from the article.

The detection equipment 114 of FIG. 1 will now be described in more detail in relation to FIGS. 2 and 3. Notably, the detection equipment 114 is described here in terms of an AM EAS system. However, the EAS tag detection method described herein can also be used in other types of EAS systems, including systems that use RF type tags and RFID EAS systems.

The detection equipment 114 will be positioned at a location adjacent to an entry/exit 204 of a secured facility (e.g., a retail store). The detection equipment 114 uses specially designed EAS marker tags ("security tags") 108 which are applied to store merchandise or other items which are stored within a secured facility. The EAS security tags 108 can be deactivated or removed by authorized personnel at the secure facility. For example, in a retail environment, the EAS security tags 108 could be removed by store employees. When an active EAS security tag 108 is detected by the detection equipment 114 in an idealized representation of an EAS detection zone 308 near the entry/exit, the detection equipment 114 will detect the presence of such security tag and will sound an alarm or generate some other suitable EAS response, as described above. Accordingly, the detection equipment 114 is arranged for detecting and preventing the unauthorized removal of articles or products from controlled areas.

As noted above in relation to FIG. 1, the detection equipment 114 includes a pair of pedestals 112, 116, which are located a known distance apart (e.g., at opposing sides of entry/exit 204). The pedestals 112, 116 are typically stabilized and supported by a base 206, 208. Notably, pedestal 112 is a master pedestal while pedestal 116 is a slave pedestal. Although one slave pedestal is shown in FIG. 2, the present invention is not limited in this regard. There can be any number of slave pedestals for a given application.

Base 206 of master pedestal 112 has a Tx/Rx scheme controller 118 disposed therein, or alternatively coupled thereto via a wired or wireless communications link. In the later configuration, the Tx/Rx scheme controller 118 may be located within a separate chassis at a location nearby to the master pedestal. For example, the Tx/Rx scheme controller 118 can be located in a ceiling just above or adjacent to the master pedestal 112. Base 206 is also communicatively coupled to base 208 via a wired or wireless communications link such that information specifying Tx/Rx schemes can be communicated from the master pedestal 112 to the slave pedestal 116 during operations thereof.

The Tx/Rx scheme controller 118 comprises hardware and/or software configured to: (a) implement a previously randomly selected Tx/Rx scheme that is unique to the master pedestal 112 (such as at a manufacture's facility or during an installation process); and/or (b) randomly select a Tx/Rx scheme from a plurality of Tx/Rx schemes to be employed by the master/slave pedestals 112, 116 during any given iteration of an EAS tag detection process. In the later scenario (b), the Tx/Rx scheme controller 118 randomly selects (1) the total number of timeslots or time windows in which an EAS exciter signal should be transmitted from a pedestal and (2) the particular timeslots or time windows in which the EAS exciter signal is to be transmitted from the pedestal.

For example, a master/slave pedestal system implements a time multiplexed transmit/receive technique. The time multiplexed transmit/receive technique uses ten time windows during each iteration of a EAS tag detection process. The Tx/Rx scheme controller 118 randomly selects: five as the total number of time windows in which an EAS exciter signal should be sent during an iteration of a tag detection process; and time windows 2, 3, 4, 5 and 10 as the particular time windows in which the EAS exciter signal should be transmitted. Information specifying the Tx/Rx scheme is then communicated from the Tx/Rx scheme controller 118 of the master pedestal 112 to the slave pedestal 116 so that the slave pedestal 116 also operates in accordance with the Tx/Rx scheme during an intended iteration of an EAS tag detection process. According to this Tx/Rx scheme, the pedestal 112 and/or pedestal 116 is only supposed to receive a response signal during time windows 2, 3, 4, 5, and 10. If pedestal 112 and/or pedestal 116 still receive(s) a response signal when an exciter signal is not transmitted therefrom during time windows 1 and 6-9, then the device from which the response signal was received is determined to be exclusive of an EAS security tag. In contrast, if the pedestal 112 and/or pedestal 116 do not receive a response signal when an exciter signal is not transmitted therefrom during time windows 1 and 6-9, then the device from which the response signal was received is deemed to be an EAS security tag. At this time, an alarm may be issued. The present invention is not limited to the particulars of this example. For example, the total number of time windows in which an EAS exciter signal should be sent can be the same or different for a plurality of iterations of the EAS tag detection process. Also, the particular time windows in which the EAS exciter signal should be sent can be the same or different for a plurality of iterations of the EAS tag detection process.

The random selections made by Tx/Rx scheme controller 118 are facilitated using a chaotic number algorithm, a random number algorithm or a pseudo-random number algorithm. Chaotic/random/pseudo-random algorithms are well known in the art, and therefore will not be described herein. Any known or to be known chaotic/random/pseudo-random algorithm can be used herein without limitation. The algorithm employed by the master pedestal 112 may be the same as or different than the chaotic/random/pseudo-random algorithm employed by another master pedestal (not shown). The seed value for the algorithm is a unique fixed value associated with the respective master pedestal or a variable value determined by the master pedestal during operations thereof.

The pedestals 112, 116 will each generally include one or more antennas that are suitable for aiding in the detection of EAS security tags, as described herein. In some scenarios, the master pedestal includes an antenna suitable for transmitting or producing an electromagnetic exciter signal field in the detection zone. The EAS transmitter is operated in a time multiplex manner using a plurality of N timestamps or windows, where N is an integer (e.g., 10). The slave pedestal includes an antenna suitable for receiving response signals generated by security tags in the detection zone. The antennas provided in the pedestals can be conventional conductive wire coil or loop designs as are commonly used in AM type EAS pedestals.

In other scenarios, the master pedestal 112 includes at least one antenna 302*a* suitable for transmitting or producing an electromagnetic exciter signal field and receiving response signals generated by EAS security tags 108 in the detection zone 308. In some scenarios, the same antenna can be used for both receive and transmit functions. Similarly, the slave pedestal 116 can include at least one antenna 302*b* suitable for transmitting or producing an electromagnetic exciter signal field and receiving response signals generated by security tags in the detection zone 308. The antennas provided in the pedestals 112, 116 can be conventional conductive wire coil or loop designs as are commonly used in AM type EAS pedestals. These antennas will sometimes be referred to herein as exciter coils. In some scenarios, a single antenna can be used in each pedestal. The single antenna is selectively coupled to the EAS receiver. The EAS transmitter is operated in a time multiplexed manner as described herein. However, it can be advantageous to include two antennas (or exciter coils) in each pedestal as shown in FIG. 2, with an upper antenna positioned above a lower antenna.

As noted above, the detection equipment 114 comprises an AM type EAS detection system. As such, each antenna is used to generate an Electro-Magnetic ("EM") field which serves as a security tag exciter signal. The security tag exciter signal causes a mechanical oscillation of a strip (e.g., a strip formed of a magnetostrictive or ferromagnetic amorphous metal) contained in an EAS security tag within a detection zone 308. As a result of the stimulus signal, the EAS security tag 108 will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the detection zone 308. As noted above, the same antenna contained in a pedestal 112, 116 can serve as both the transmit antenna and the receive antenna. Accordingly, the antennas in each of the pedestals 112, 116 can be used in several different modes to detect a security tag exciter signal. These modes will be described below in further detail.

Figure 4:
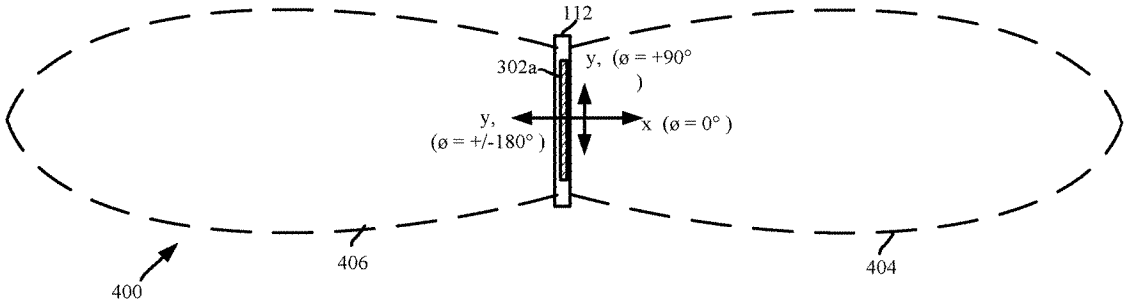
FIGS. 4 and 5 are drawings which are useful for understanding a main field and a backfield of antennas which are used in the EAS detection system of FIG. 2.
Figure 5:
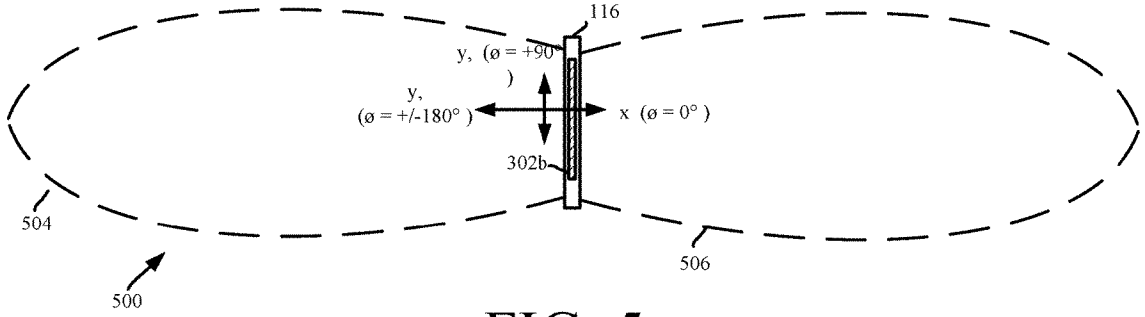

Referring now to FIGS. 4 and 5, there are shown exemplary antenna field patterns 400, 500 for antennas 302*a*, 302*b* contained in pedestals 112, 116. As is known in the art, an antenna radiation pattern is a graphical representation of the radiating (or receiving) properties for a given antenna as a function of space. The properties of an antenna are the same in transmit and receive modes of operation. As such, the antenna radiation pattern shown is applicable for both transmit and receive operations as described herein. The exemplary antenna field patterns 400, 500 shown in FIGS. 4-5 are azimuth plane patterns representing the antenna patterns in the x, y coordinate plane. Each azimuth plane pattern is represented in polar coordinate form and is sufficient for understanding the inventive arrangements. The azimuth antenna field patterns shown in FIGS. 4-5 are a useful way of visualizing the direction in which the antennas 302*a*, 302*b* will transmit and receive signals at a particular power level.

Figure 6:
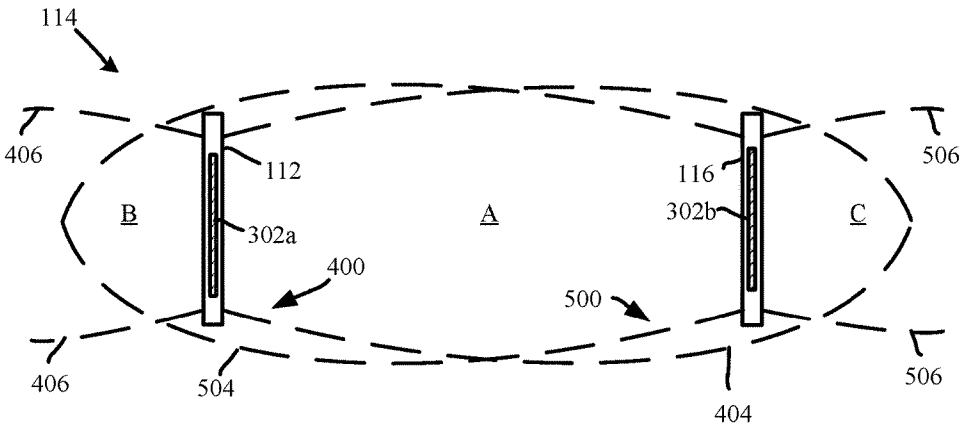
FIG. 6 is a drawing which is useful for understanding a detection zone in the EAS detection system of FIG. 2.

The antenna field pattern 400 shown in FIG. 4 includes a main lobe 404 with a peak at ø=0° and a backfield lobe 406 with a peak at angle ø=180°. Conversely, the antenna field pattern 500 shown in FIG. 5 includes a main lobe 504 with its peak at ø=180° and a backfield lobe 506 with a peak at angle ø=0°. In the detection equipment 114, each pedestal 112, 116 is positioned so that the main lobe of an antenna contained therein is directed into the detection zone 308. Accordingly, a pair of pedestals 112, 116 in the detection equipment 114 will produce overlap in the antenna field patterns 400, 500, as shown in FIG. 6. Notably, the antenna field patterns 400, 500 shown in FIG. 6 are scaled for purposes of understanding the present invention. In particular, the patterns show the outer boundary or limits of an area in which an exciter signal of particular amplitude applied to antennas 302*a*, 302*b* will produce a detectable response in an EAS security tag. However, it should be understood that a security tag within the bounds of at least one antenna field pattern 400, 500 will generate a detectable response when stimulated by an exciter signal.

The overlapping antenna field patterns 400, 500 in FIG. 6 will include an area A where there is overlap of main lobes 404, 504. However, it can be observed in FIG. 6 that there can also be some overlap of a main lobe of each pedestal with a backfield lobe associated with the other pedestal. For example, it can be observed that the main lobe 504 overlaps with the backfield lobe 406 within an area B. Similarly, the main lobe 404 overlaps with the backfield lobe 406 in an area C. Area A between pedestals 112, 116 defines the detection zone 308 in which active security tags should cause the detection equipment 114 to generate an alarm response. Security tags in area A are stimulated by energy associated with an exciter signal within the main lobes 404, 504 and will produce a response which can be detected at each antenna. The response produced by a security tag in area A is detected within the main lobes of each antenna and processed in the Tx/Rx scheme controller 118. Notably, a security tag in areas B or C will also be excited by the antennas 302*a*, 302*b*. The response signal produced by a security tag in these areas B and C will also be received at one or both antennas.

Referring now to FIG. 7, there is provided a schematic illustration that is useful for understanding the novel EAS detection process of this document. The EAS detection process is subject to validating the presence of an EAS security tag. One method of validating the tag presence is by use of a "transmit off check". In an EAS detection scheme for pulsed systems, a transmit/receive sequence is used as a reliable double check. The transmit/receive sequence can include transmitting and receiving during some of a plurality of time windows. For example, an EAS exciter signal is transmitted during time windows 702-706 of FIG. 7, and not during time window 708 of FIG. 7. This means that a window 708 transmit opportunity is a "transmit off check" in which the EAS exciter signal is not transmitted from a pedestal. A response signal is received during time windows 702-708 of FIG. 7. Since a transmitter is still receiving a response signal during time window 708 (i.e., when the transmitter did not transmit an exciter signal), then the device from which the response signal was received is determined to be exclusive of an EAS security tag. The present invention is not limited to the particulars of this example.

Figure 2:
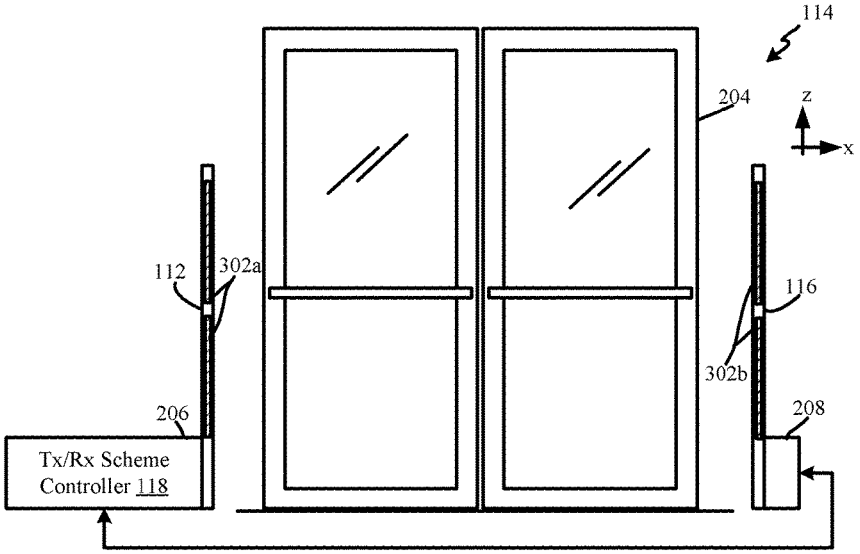
FIG. 2 is a side view of an EAS detection system.

Notably, in some scenarios, the novel EAS detection process involves a rolling code validation scheme in which the Tx/Rx scheme implemented by the master/slave pedestals changes during each iteration of an EAS tag detection process in accordance with a chaotic/random/pseudo-random algorithm employed by a Tx/Rx scheme controller (e.g., controller 118 of FIG. 2). An example of such a rolling code validation scheme 800 is schematically illustrated in FIG. 8. The result of implementing a rolling code validation scheme is that the total detection time is significantly reduced as there would be no chance of a false alarm from another source (e.g., a master/slave pedestal pair in relatively close proximity to the master/slave pedestals implementing the rolling code). In this regard, it should be understood that the rolling code validation scheme is robust as external noise sources and other systems would not match the Tx/Rx schemes employed during iterations of the EAS tag detection process. Also, time to reach a detection decision in general would be faster than other EAS systems known.

As shown in FIG. 8, a different Tx/Rx scheme is employed in three consecutive iterations of an EAS tag detection process. For example, the Tx/Rx scheme employed in a first iteration of the EAS tag detection process involves transmitting an EAS exciter signal only during time windows 802, 804, 810, 814, 820. Thus, transmit opportunities associated with time windows 806, 808, 812, 816, 818 are used for "transmit off checks" purposes to further establish a Tx/Rx code and add robustness to the EAS tag detection process. The Tx/Rx scheme employed in a second iteration of the EAS tag detection process involves transmitting the EAS exciter signal only during time windows 802, 804, 806, 808, 812, 816. As such, transmit opportunities associated with time windows 810, 814, 818, 820 are used for "transmit off checks" purposes to further establish a Tx/Rx code and add robustness to the EAS tag detection process. The Tx/Rx scheme employed in a third iteration of the EAS tag detection process involves transmitting the EAS exciter signal only during time windows 802, 804, 810, 812, 814, 818, 820. Accordingly, transmit opportunities associated with time windows 806, 808, 816 are used for "transmit off checks" purposes to further establish a Tx/Rx code and add robustness to the EAS tag detection process. Notably, the total number of time windows in which the EAS exciter signal is sent during the first, second and third iterations is different (i.e., 5 for the first iteration, 6 for the second iteration, 7 for the third iteration). Also, at least one of the time windows in which the EAS exciter signal is sent during the first, second and third time windows is different. A chaotic/random/pseudo-random algorithm is used to determine the three different Tx/Rx schemes. The present invention is not limited to the particulars of this example. For example, a pre-defined set of Tx/Rx schemes unique to the master pedestal can be employed, wherein the Tx/Rx schemes are selectively cycled through by the master pedestal.

Figure 3:
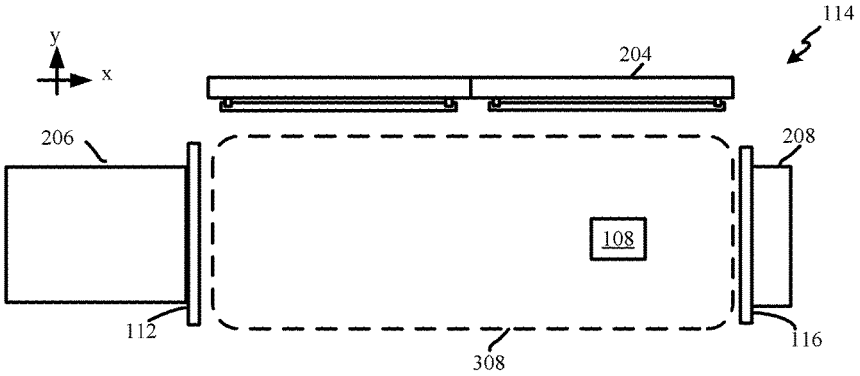
FIG. 3 is a top view of the EAS detection system in FIG. 2, which is useful for understanding an EAS detection zone thereof.
Figure 9:
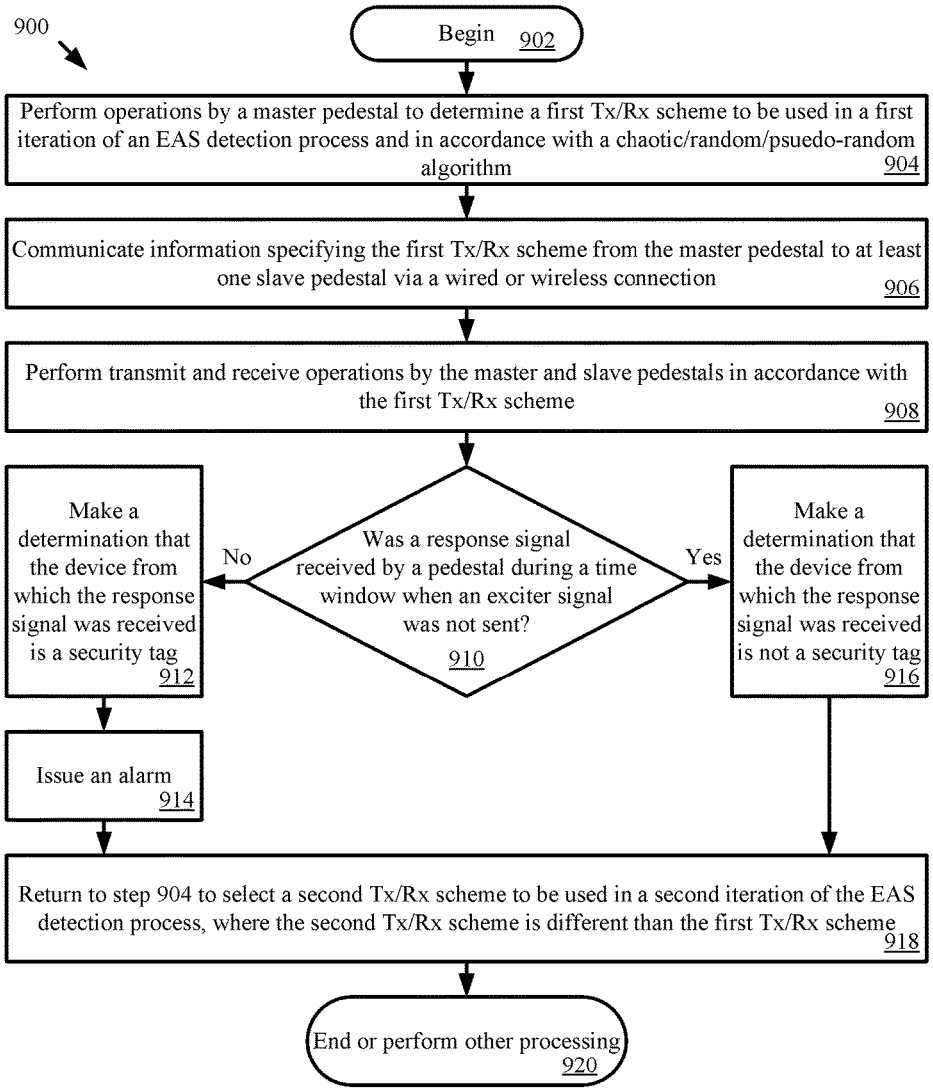
FIG. 9 is a flow diagram of an exemplary EAS tag detection process.

Referring now to FIG. 9, there is provided a flow diagram of an exemplary method 900 for detecting an EAS tag in a surveillance area (e.g., surveillance zone 308 of FIG. 3). Method 900 begins with step 902 and continues with step 904 where operations are performed by a master pedestal (e.g., pedestal 112 of FIGS. 1-6) to determine a Tx/Rx scheme to be used in a first iteration of an EAS tag detection process. The Tx/Rx scheme is determined in accordance with a chaotic/random/pseudo-random algorithm.

In some scenarios, a pre-defined set of Tx/Rx schemes unique to the master pedestal are employed. Accordingly, the master pedestal randomly selects one of the Tx/Rx schemes of the pre-defined set to use during the first iteration of the EAS tag detection process. The Tx/Rx schemes of the pre-defined set have (A) different total numbers of time windows in which an EAS exciter signal should be transmitted from a pedestal and (b) at least one different time window in which the EAS exciter signal is to be transmitted from the pedestal.

In other scenarios, a pre-defined set of Tx/Rx schemes is not employed. As such, the master pedestal randomly selects: (1) the total number of time windows in which an EAS exciter signal should be transmitted from a pedestal; and (2) the particular time windows of a plurality of time windows in which the EAS exciter signal is to be transmitted from the pedestal. The master pedestal then generates the Tx/Rx scheme based on the selection results (1) and (2). Random selections (1) and (2) can be made in accordance with the same or different chaotic/random/pseudo-random algorithm. The same or different seed value for the chaotic/random/pseudo-random algorithm(s) can also be used to make selections (1) and (2). The seed value(s) can be pre-stored in the master pedestal or dynamically generated by the master pedestal during operation thereof.

Upon completing step 904, step 906 is performed in which information specifying the first Tx/Rx scheme is communicated from the master pedestal to at least one slave pedestal (e.g., pedestal 116 of FIGS. 1-6). Next in step 908, the master and slave pedestals perform transmit and receive operations in accordance with the first Tx/Rx scheme. A decision is them made in decision step 910 as to whether or not a response signal was received by the master pedestal and/or the slave pedestal during a time window when an exciter signal was not sent.

If a response signal was not received during the time windows in which the exciter signal was not sent from the master pedestal and/or slave pedestal [910:NO], then it is determined that the responding device is an EAS security tag, as shown by step 912. In this case, an alarm is issued in step 914. Thereafter, step 918 is performed which will be described below.

In contrast, if a response signal was received during at least one time window in which the exciter signal was not sent from the master pedestal and/or slave pedestal [910: YES], then it is determined that the responding device is not an EAS security tag, as shown by step 916. In this case, an alarm would not be issued. Accordingly, method 900 continues with step 918.

Step 918 involves returning to step 904 so that a second Tx/Rx scheme is selected by the master pedestal for use during a second iteration of the EAS detection process. The second Tx/Rx scheme is different than the first Tx/Rx scheme. For example, the second Tx/Rx scheme: has a different total number of time windows in which an EAS exciter signal should be sent as compared to that of the first Tx/Rx scheme; and/or has a different set of time windows in which the EAS exciter signal is to be sent. Subsequent to completing step 918, step 920 is performed where method 900 ends or other processing is performed.

Figure 10:
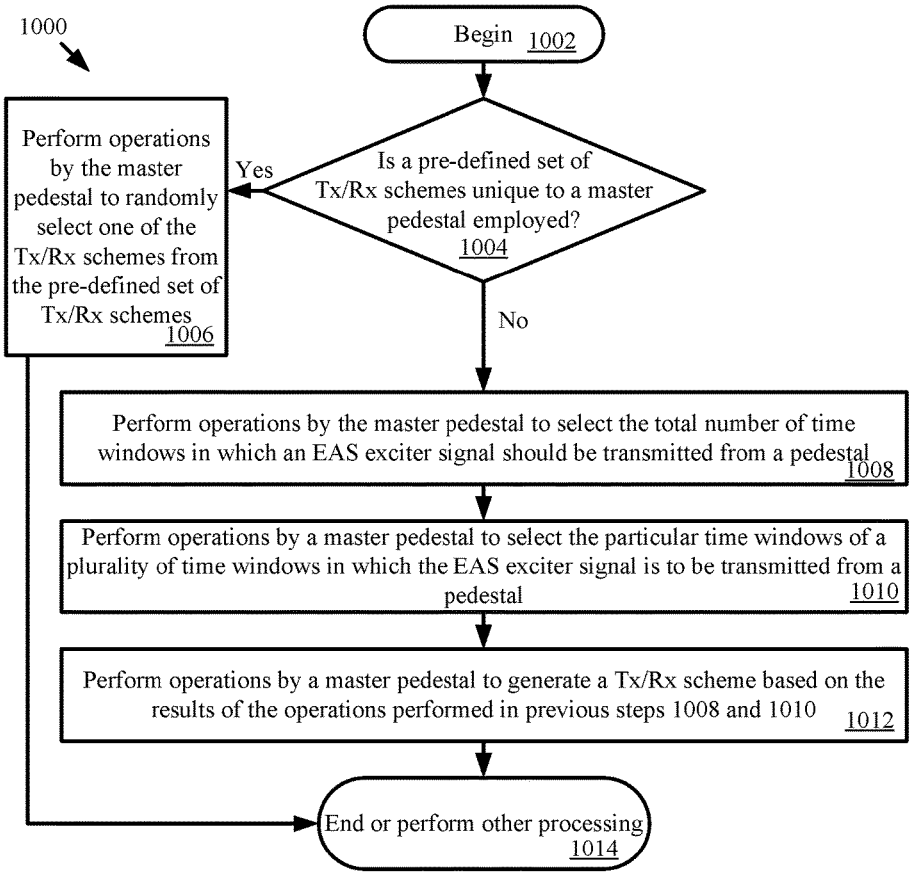
FIG. 10 is a flow diagram of an exemplary method for randomly selecting a Tx/Rx scheme.

Referring now to FIG. 10, there is provided a flow diagram of an exemplary Tx/Rx scheme selection process 1000 performed by a master pedestal (e.g., master pedestal 112 of FIGS. 1-6). Process 1000 can be performed in step 904 of FIG. 9.

Process 1000 begins with step 1002 and continues with a decision step 1104. If a pre-defined set of Tx/Rx schemes are employed [1004:YES], then step 1006 is performed. In step 1006, the master pedestal performs operations to randomly select one of the Tx/Rx schemes from the pre-defined set of Tx/Rx schemes. The Tx/Rx schemes of the pre-defined set have (A) different total numbers of time windows in which an EAS exciter signal should be transmitted from a pedestal and (b) at least one different time window in which the EAS exciter signal is to be transmitted from the pedestal. Subsequent to completing step 1006, step 1014 is performed where method 1000 ends or other processing is performed.

If a pre-defined set of Tx/Rx schemes is not employed [1004:NO], then step 1008 is performed where the master pedestal randomly selects the total number of time windows in which an EAS exciter signal should be transmitted from a pedestal. In a next step 1010, the master pedestal randomly selects the particular time windows of a plurality of time windows in which the EAS exciter signal is to be transmitted from the pedestal. The random selections of steps 1008 and 1010 can be made in accordance with the same or different chaotic/random/pseudo-random algorithm. The same or different seed value for the chaotic/random/pseudo-random algorithm(s) can also be used to make selections (1) and (2). The seed value(s) can be pre-stored in the master pedestal or dynamically generated by the master pedestal during operation thereof. The master pedestal then generates the Tx/Rx scheme based on the results of operations performed in previous steps 1008 and 1010, as shown by step 1012. Subsequent to completing step 1012, step 1014 is performed where method 1000 ends or other processing is performed.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for detecting the presence of a security tag, comprising:

performing operations by a master pedestal of an Electronic Article Surveillance ("EAS") system to determine a first Tx/Rx scheme to be used during a first iteration of an EAS tag detection process based on (A) a first total number of time windows randomly selected from a plurality of total number of time windows in which an EAS exciter signal should be transmitted from at least one pedestal, and (B) first time windows randomly selected from a plurality of time windows in which the EAS exciter signal can be sent during the EAS tag detection process;

communicating information specifying the first Tx/Rx scheme from the master pedestal to at least one slave pedestal of the EAS system;

performing transmit and receive operations by the master and slave pedestals in accordance with the first Tx/Rx scheme; and transmitting the EAS exciter signal from the at least one pedestal a first number of times during a second iteration of the EAS tag detection process, where the first number of times is different than a second number of times the EAS exciter signal was transmitted from the at least one pedestal during the first iteration of the EAS tag detection process;

wherein the first Tx/Rx scheme specifies during which time windows of the plurality of time windows a pedestal is to only transmit, only receive, or both transmit and receive.

2. The method according to claim 1, wherein the first total number of time windows is different than a second total number of time windows on which a second Tx/Rx scheme was based, the second Tx/Rx scheme used by the master pedestal during the second iteration of the EAS tag detection process.

3. The method according to claim 1, wherein the first time windows are different than second time windows randomly selected from the plurality of time windows for purposes of determining a second Tx/Rx scheme to be used by the master pedestal during the second iteration of the EAS tag detection process.

4. The method according to claim 1, further comprising making a determination by the master pedestal or the slave pedestal that a responding device is not an EAS security tag when a response signal is received by at least one of the master pedestal and the slave pedestal during a time window in which the EAS exciter signal was not transmitted.

5. The method according to claim 1, further comprising:

making a determination by the master pedestal or the slave pedestal that a responding device is an EAS security tag when a response signal is received by at least one of the master pedestal and the slave pedestal exclusively during time windows in which the EAS exciter signal was transmitted; and issuing an alarm indicating that the presence of an EAS security tag has been detected.

6. The method according to claim 1, wherein the master pedestal randomly selects the first Tx/Rx scheme from a pre-defined set of Tx/Rx schemes.

7. The method according to claim 1, wherein the master pedestal randomly selects the total number of time windows and the first time windows using a first chaotic, random or pseudo-random algorithm.

8. The method according to claim 7, wherein the first chaotic, random or pseudo-random algorithm is different than a second chaotic, random or pseudo-random algorithm employed by another master pedestal.

9. The method according to claim 7, wherein a seed value for the first chaotic, random or pseudo-random algorithm is a unique fixed value associated with the master pedestal or a variable value determined by the master pedestal during operations thereof.

10. The method according to claim 1, wherein the master pedestal randomly selects a different Tx/Rx scheme for a plurality of iterations of the EAS tag detection process.

11. An Electronic Article Surveillance ("EAS") system, comprising:

a master pedestal having an electronic circuit configured to:

determine a first Tx/Rx scheme to be used during a first iteration of an EAS tag detection process based on (A) a first total number of time windows randomly selected from a plurality of total number of time windows in which an EAS exciter signal should be transmitted from at least one pedestal, and (B) first time windows randomly selected from a plurality of time windows in which the EAS exciter signal can be sent during the EAS tag detection process;

communicate information specifying the first Tx/Rx scheme to at least one slave pedestal of the EAS system;

perform transmit and receive operations in accordance with the first Tx/Rx scheme; and perform transmit operations to cause the EAS exciter signal to be transmitted from the master pedestal a first number of times during a second iteration of the EAS tag detection process, where the first number of times is different than a second number of times the EAS exciter signal was transmitted from the at least one pedestal during the first iteration of the EAS tag detection process wherein the first Tx/Rx scheme specifies during which time windows of the plurality of time windows the master pedestal and the slave pedestal are to only transmit, only receive, or both transmit and receive.

12. The EAS system according to claim 11, wherein the first total number of time windows is different than a second total number of time windows on which a second Tx/Rx scheme was based, the second Tx/Rx scheme used by the master pedestal during the second iteration of the EAS tag detection process.

13. The EAS system according to claim 11, wherein the first time windows are different than second time windows randomly selected from the plurality of time windows for purposes of determining a second Tx/Rx scheme to be used by the master pedestal during the second iteration of the EAS tag detection process.

14. The EAS system according to claim 11, wherein the master pedestal or the slave pedestal makes a determination that a responding device is not an EAS security tag when a response signal is received by at least one of the master pedestal and the slave pedestal during a time window in which the EAS exciter signal was not transmitted.

15. The EAS system according to claim 11, wherein the master pedestal or the slave pedestal:

makes a determination that a responding device is an EAS security tag when a response signal is received by at least one of the master pedestal and the slave pedestal exclusively during time windows in which the EAS exciter signal was transmitted; and issues an alarm indicating that the presence of an EAS security tag has been detected.

16. The EAS system according to claim 11, wherein the master pedestal randomly selects the first Tx/Rx scheme from a pre-defined set of Tx/Rx schemes.

17. The EAS system according to claim 11, wherein the master pedestal randomly selects the total number of time windows and the first time windows using a first chaotic, random or pseudo-random algorithm.

18. The EAS system according to claim 17, wherein the first chaotic, random or pseudo-random algorithm is different than a second chaotic, random or pseudo-random algorithm employed by another master pedestal.

19. The EAS system according to claim 17, wherein a seed value for the first chaotic, random or pseudo-random algorithm is a unique fixed value associated with the master pedestal or a variable value determined by the master pedestal during operations thereof.

20. The EAS system according to claim 11, wherein the master pedestal randomly selects a different Tx/Rx scheme for a plurality of iterations of the EAS tag detection process.

* * * * *